US005457292A

United States Patent [19]

Harr

[11] Patent Number: 5,457,292

[45] Date of Patent: Oct. 10, 1995

[54] LOAD INTERRUPTING SWITCH FOR LIVE FRONT PADMOUNTED SWITCHGEAR

[75] Inventor: Deborah L. Harr, Columbia, Mo.

[73] Assignee: Hubbell Incorporated, Orange, Conn.

[21] Appl. No.: 312,131

[22] Filed: Sep. 26, 1994

[51] Int. Cl.[6] ..... H01H 33/12; H01H 85/00

[52] U.S. Cl. ..... 218/8; 218/1; 218/43; 337/6; 337/158

[58] Field of Search ..... 200/144 R, 144 A, 200/151, 146 R, 146 A; 361/626, 642; 337/6–8, 158, 273

[56] References Cited

U.S. PATENT DOCUMENTS

| | | | |
|---|---|---|---|
| Re. 32,321 | 12/1986 | Tobin | 200/82 R |
| 4,083,028 | 4/1978 | Haubein et al. | 337/144 |
| 4,268,811 | 5/1981 | Evans et al. | 337/156 |
| 4,323,871 | 4/1982 | Kamp et al. | 337/7 |
| 4,804,809 | 2/1989 | Thompson, Jr. et al. | 200/17 R |
| 5,254,814 | 10/1993 | Harr | 200/17 R |

*Primary Examiner*—J. R. Scott

*Attorney, Agent, or Firm*—Jerry M. Presson; Warren N. Williams

[57] ABSTRACT

A load interrupter device is provided for live front padmounted high voltage switchgear unit wherein circuit interruption is independent of the speed at which a lineman opens the switch of the switchgear. The interrupter includes an insulating body having a fixed terminal and a moveable terminal spaced therefrom which forms a part of manually operable switch structure. A conductive element within the body connected to the moveable terminal normally engages the fixed terminal. A pair of moveable conductive members are also provided in the body, with one of the conductive members normally engaging a contact electrically connected to the first terminal, while the second member is joined to the second terminal for movement therewith. Spring mechanism interconnecting the two members and in association with a detent causes the first conductive member to be retained in engagement with its associated contact until after the conductive element clears the first terminal whereupon the first conducting member is then acceleratedly moved out of engagement with the first contact to break the circuit and create an arc which is rapidly suppressed by material making up a part of the interrupter body.

12 Claims, 4 Drawing Sheets

30
32
34
35
36
37
38
42
64
66
80
82
84
86
88
90
90a
90b
92
92a
92b
94
96
96a
96b
98
100
102
102a
104
110
110a
112
114
115
116
116a
118
121
122
124
126
128

30
32
34
35
36
37
38
42
64
66
80
82
84
86
88
90
90a
90b
92
92a
92b
94
96
96a
96b
98
100
102
102a
104
110
110a
112
114
115
116
116a
118
121
122
124
126
128

LOAD INTERRUPTING SWITCH FOR LIVE FRONT PADMOUNTED SWITCHGEAR

BACKGROUND OF THE INVENTION

1. Field of the Invention

This invention relates to a load interrupter device especially useful for live front padmounted high voltage switchgear having manually operable switch structure which includes either a fuse or a disconnect switchblade.

2. Description of the Prior Art

Padmounted electrical switchgear for use in electrical distribution systems and particularly underground systems, may be of the air-insulated, live front type in order to provide desirable in-air visibility, in-air switching and in-air installation. Switchgear of this type often includes fuses to protect the distribution system from fault currents while providing coordination with upstream and downstream protective devices.

The switchgear has manually actuated switch structure which allows a lineman to selectively open distribution circuits connected to the switchgear. The switch structure may include a swingable switchblade, or if a power fuse is provided, the fuse may serve as the pivotal switch element. In either event, it is necessary that a load interrupter be provided in association with the switch in order to prevent arcing from occurring across the switch elements during opening of the switch by the lineman.

Load interrupters have previously been provided for this purpose, as for example the device which is shown and described in U.S. Pat. No. 4,268,811. In that device, a moveable conductive element mounted within an insulative housing is connected to a shiftable terminal forming a part of the switch. The conductive element normally engages internal contacts within the body of the device that are in turn electrically connected to a second fixed terminal. An extension on a pivotally mounted power fuse releasably engages the moveable terminal so that when the power fuse is pivoted to open the circuit, the moveable terminal and thereby the conductive element in the interrupter body are shifted to disconnect the element from its associated contacts. Synthetic resin material within the interrupter body produces gases when an arc is drawn between the conductive element and the internal contacts to extinguish an arc that is drawn between the contacts and the elements upon separation of the conductive components.

In the interrupter device of the '811 patent, the time required to effect separation of the conductive element from its associated contacts, is a function of the speed with which the lineman pulls on the fuse to disengage the extension thereof from the interrupter device contacts. If that speed of manual operation is relatively slow, undesirable major arcing can occur within the interrupter body.

Also, since the arc is drawn between the contacts that carry the continuous current load, damage that might occur during excessive arcing could effect the ability of the device to carry the continuous load current without overheating, and eventually burning up of the components.

SUMMARY OF THE INVENTION

In accordance with the present invention, a load interrupter is provided which is especially beneficial when used in padmounted fused high voltage switchgear applications for underground distribution systems. The interrupter may advantageously be used in switchgear units which contain fuses only, or fuses and switches combined in the same unit.

The interrupter device includes an elongated tubular body of insulating material which mounts a first fixed internal terminal and a second moveable external terminal in spaced relationship therefrom. A conductive element is provided within the interrupter body that is connected to the moveable terminal and normally engages contacts within the body that are connected to the fixed terminal. The conductive element between the two terminals serves as the primary current path through the interrupter when the latter is in a closed position.

Another set of contacts in the interrupter body are electrically connected to the fixed terminal. A pair of elongated, axially aligned conductive members are also shiftably mounted in the interrupting housing in generally parallel relationship to the conductive element. A first conductive member normally engages the internal contacts within the interrupter body. The second conductive member is connected to the moveable terminal for movement therewith.

Spring mechanism joins adjacent ends of the conductive members. A spring biased detent releasably retained in an annular groove in the first member serves to retain that member in engagement with its contacts during movement of the second member along with the second terminal as the switch is opened, until such time as the conductive element also joined to the moveable terminal has cleared its associated contacts.

Thereupon, flange means on the first member functions to overcome the detent force against the first member and acceleratedly move the first conductive member out of engagement with its contacts, thus breaking the circuit, but at the same time creating an arc internally of the interrupter body. This arc is extinguished by material making up a part of the body of the interrupter.

By virtue of the fact that the first conductive member is retained in its initial position until after the main conductive element within the interrupter has cleared its contacts connected to the fixed terminal, and that such member when it does move is acceleratedly shifted out of engagement with its contacts, results in circuit interruption which is independent of the speed at which the lineman manually operates the pivotal switch element, whether it be a switchblade, or a fuse which functions as a switch component.

DETAILED DESCRIPTION OF THE PREFERRED EMBODIMENT

Figure 1:
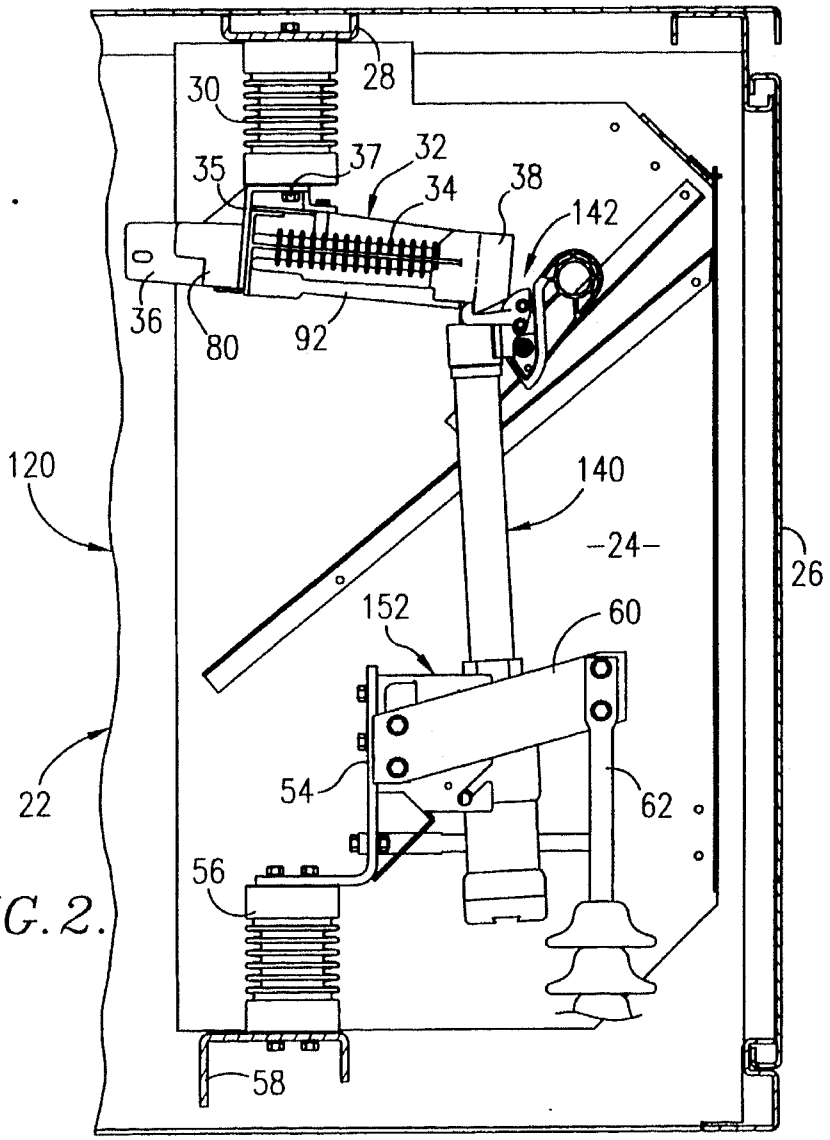
FIG. 1 is a fragmentary vertical cross sectional view of one compartment of live front padmounted fused switchgear having a load interrupting device constructed in accordance with the preferred concepts of the present invention, and showing one type of conventional power fuse that may be used in association with the interrupter.

The high voltage live front padmounted fused switchgear unit broadly designated by the numeral 20 in FIG. 1 of the drawings typically includes a housing defined by cabinet 22 and having a switch compartment (not shown) along with a fuse side compartment 24. Access to compartment 24 is gained through door 26. Units 20 are usually adapted for three-phase circuit operation and in many instances have side-by-side compartments 24, each of which may accommodate separate three phase service.

A cross member 28 in the upper of compartment 24 mounts a series of depending insulator supports 30, one for each electrical phase. A load interrupting device 32 embodying the preferred concepts of the present invention is secured to and carried by each of the insulators 30 through the medium of a mounting member 35 connected to insulator 30 by fastening means 37. Each device 32 is adapted to be connected to one phase of an electrical circuit. Device 32 has a main body 34 of insulating material, such as Delrin, which supports a fixed terminal 36 on one end thereof for connection to the circuit.

The opposite end of device 32 has cover structure 38 overlying a moveable terminal not depicted in FIG. 1, and which receives the contact extension of a conventional power fuse 40 such as the type available from S & C Electric Company, Chicago, Ill., as its Model SML-20 power fuse. The contact and latch assembly 42 of fuse 40 may, for example, be constructed generally in a manner as illustrated and described in S & C's U.S. Pat. No. 4,268,811, which is incorporated herein by reference thereto.

The central tubular body 44 of power fuse 40 is of insulating material and typically houses a metallic fusible element of silver, nickel-chrome, or equivalent material. The uppermost end of tube 44 is telescoped into the metallic end ferrule 46 of contact and latch assembly 42 while the lower end of fuse tube 44 is received within a metal contact ferrule 48 forming a part of lower fuse body 50. A U-shaped fuse supporting bracket 52 pivotedly receives body 50 of fuse 40 and is mounted on an L-shaped support 54 carried by and projecting upwardly from a respective insulator 56 secured to a cross member 58 within compartment 24 and located directly below cross member 28. The terminal 60 mounted on bracket 52 is adapted to be connected to a conductor 62 that is in the same circuit that is connected to terminal 36 of interrupting device 32.

Figure 3:
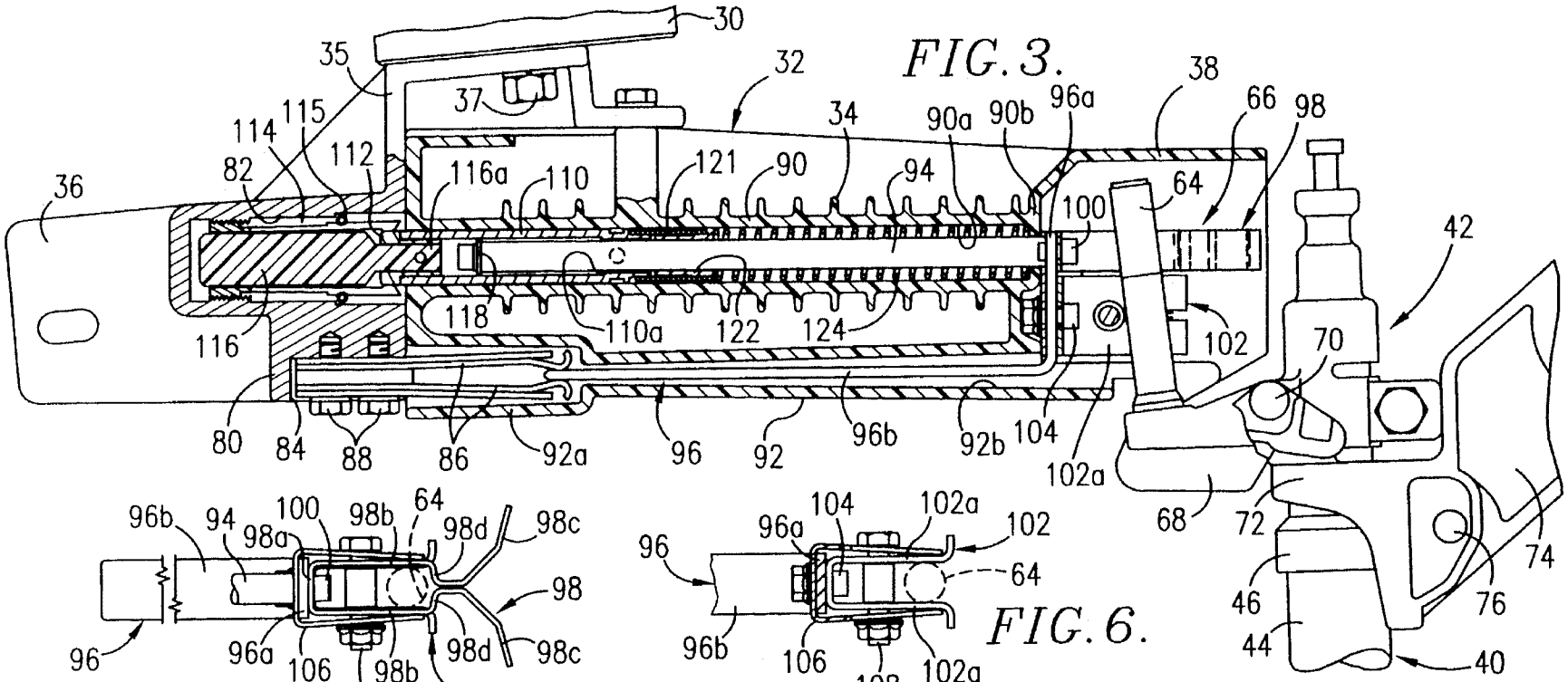
FIG. 3 is an enlarged, fragmentary vertical cross sectional view of the load interrupting device of this invention, shown in operable association with the power fuse illustrated in FIG. 1, and illustrating the components in their closed, continuous current carrying positions.
Figure 6:
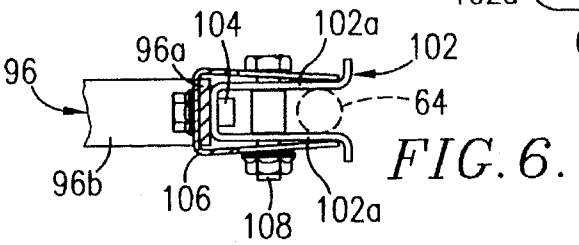
FIG. 6 is a fragmentary, horizontal cross sectional view of the moveable terminal of the load interrupting device as depicted in FIG. 5, and taken on a horizontal line immediately below the fuse extension contacting and arcing horns of the terminal.

Viewing FIG. 3, it is to be observed that contact extension 64 of contact and latch assembly 42 forming a part of power fuse 40 comprises an upstanding conductive rod normally received within cover structure 38 of interrupter body 34 and engaging the moveable terminal 66 of the interrupter device 32. Assembly 42 includes a latch member 68 (FIG. 1) which releasably engages cover structure 38 of body 34. Latch member 68 pivots about axis 70 and is rotated by the camming segment 72 of actuating member 74 rotatable about axis 76. Actuating member 74 has a ring 78 for facilitating rotation thereof with a hot stick hook or the like.

Returning to FIG. 3, terminal 36 is integral with and projects outwardly from a metal terminal end fitting 80 which has a central bore 82 closed at the outer end thereof, and open at its innermost end. End fitting 80 also has a notch 84 in the normally lowermost surface thereof for receiving a pair of fixed blade contacts 86 secured to end fitting 80 by fasteners 88.

Main body 34 of device 32 is constructed of insulating material and comprises a finned main tubular section 90 coaxial with bore 82, and a second tubular section 92 of rectangular cross section which communicates with notch 84 and has an enlarged portion **92*a* that houses the blade contacts 86**.

An elongated member in the nature of a conductive metal rod 94 is reciprocably housed within the bore **90*a* of tubular section 90 and extends substantially the full length thereof. An L-shaped main current carrying contact blade 96, has an upright leg 96*a* which is fastened to the end of member 94 projecting outwardly from the bore 90*a* of tubular section 90 and a generally horizontal main leg 96*b* received within the bore 92*b* of section 92 for engagement with blade contacts 86**.

Figure 5:
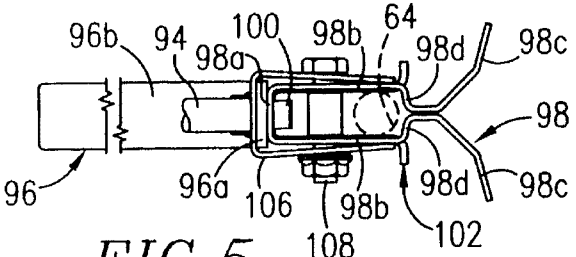
FIG. 5 is a fragmentary plan view of the moveable terminal of the load interrupting device and showing the manner in which the contacts of the terminal releasably engage a contact extension on the upper end of the power fuse shown in FIG. 3.

The upright leg **96*a* of contact blade 96 serves as means for mounting the moveable terminal 66 which engages contact extension 64 of fuse 40. The terminal 66 has an elongated contact element 98 which includes a central bight segment 98*a* fastened to leg 96*a* by a fastener 100, opposed, generally parallel main leg portions 98*b* and generally J-shaped outer stop and arcing horn portions 98*c* as is best shown in FIG. 5. The base segments of the J-shaped leg portions 98*c* are normally in abutting relationship such that the internal segments 98*d* thereof function as releasable stops for contact extension 64. The leg portions 98*b* of contact element 98 will spread when force is applied against stop defining segments 98*d* to allow the contact extension 64 to clear the contact element 98 when the fuse 40 is rotated in a clockwise direction viewing FIG. 3**, as will be explained in greater detail hereinafter.

Another U-shaped contact member 102 is mounted on the upright leg **96*a* of contact blade 96 immediately below contact element 98 through the medium of a fastener 104. The main legs 102*a* of contact member 102 are spaced a distance to embrace and contact the extension 64 of fuse 40. A U-shaped retainer 106 is carried by leg 96*a* of blade 96 and provided with outer leg portions which embrace legs 102*a* of contact member 102 to maintain the legs 102*a* in firm electrical engagement with the contact extension 64. A fastener 108 extending between the opposed main legs of retainer 106 limit the relative movement of contact legs 102***a* away from one another when the contact extension 64 is therebetween.

As best shown in FIG. 3, a metal sleeve 110 is telescoped over the innermost end of conductive rod member 94 adjacent bore 82 of end fitting 80. A tubular contact 112 is secured to the extremity of sleeve 110 in proximity to bore 82 in disposition to normally engage the leaves of a petal contact 114 threaded into bore 82. A flexible, circular retainer 115 surrounds the leaves of petal contact 114 to bias the contact leaves into firm engagement with the contact 112. A cylindrical arc extinguishing member 116 of synthetic resin material, as for example Delrin, of a diameter to be complementally received within petal contact 114, has an inner reduced diameter extension 116*a* affixed to contact 112.

The end of conductive rod member 94 adjacent member 116 has flange means 118 thereon of a diameter slightly less than the main internal diameter of sleeve 110, but greater than the external diameter of conductive rod member 94. Flange means 118 is disposed to engage the inwardly directed internal shoulder 110*a* of sleeve 110 during axial movement of conductive rod member 94 with respect to sleeve 110.

A coil spring 121 is partially threaded over the end of sleeve 110 proximal to shoulder 110*a*, and is also partially threaded onto a cylindrical element 122 affixed to the outer surface of conductive rod member 94 intermediate the ends of the latter. A larger coil spring 124 is located within the bore of tubular section 90 between cylindrical element 122 and the end wall 90*b* of tubular section 90.

Sleeve 110 is provided with an annular groove 126 in the outer circumference thereof adjacent shoulder 110*a* for receiving a spring biased detent 128 of a detent assembly 130 carried by boss 132 integral with tubular section 90.

Figure 4:
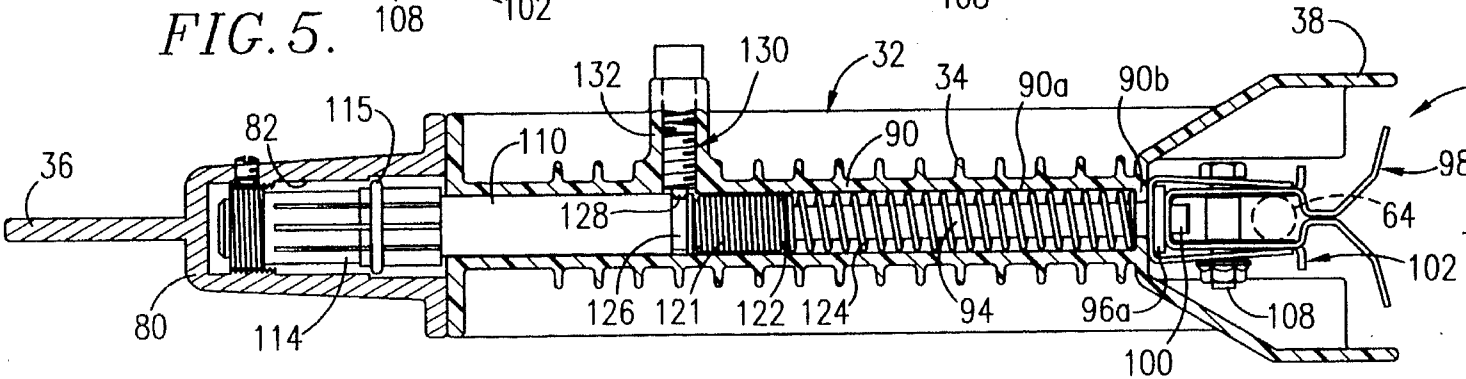
FIG. 4 is a horizontal cross sectional view of the load interrupting device as depicted in FIG. 3.

In operation, the standby condition of interrupter 32 and associated fuse 40 is illustrated in FIGS. 3 and 4 of the drawings. The current path is through terminal 36, end fitting 80, blade contacts 86, contact blade 96, moveable terminal 66, contact extension 64, ferrule 46, the meltable fuse element within fuse body 44, ferrule 48, bracket 52, terminal 60, and conductor 62.

Switchgear unit 20, as previously indicated, typically is configured to be used in at least one three phase circuit. The three phase circuit made up of conductors connected to respective switches on the switch side of the switchgear may be interrupted by opening of the ganged switches. In certain instances though, where the individual phases are connected to independent service loads, it is desirable that a lineman be able to isolate only one of the phases of the circuit without interrupting all three phases.

Load interrupting device 32 allows the lineman to interrupt a selected phase without arcing of the current when the contact and latch assembly 42 of fuse 40 is pulled away from the terminal 66 of device 32. Arcing that occurs takes place within arc control section 90 of device 32, where the arc is extinguished before contact extension 64 disengages from terminal 66.

Thus, in this instance, the lineman opens the door 26 of cabinet 22 to gain access to compartment 20. An insulated hook stick is attached to the ring 78 of the fuse 40 carrying the current phase to be interrupted. As a force is exerted on ring 78, the actuating member 74 rotates about axis 76 to cause the camming segment 72 to exert a force on latch member 68. That camming force rotates latch member 68 in a counterclockwise direction viewing FIG. 1 so that fuse 40 may be swung in a clockwise direction viewing FIG. 1 about the fuse pivot axis on bracket 52.

Figure 7:
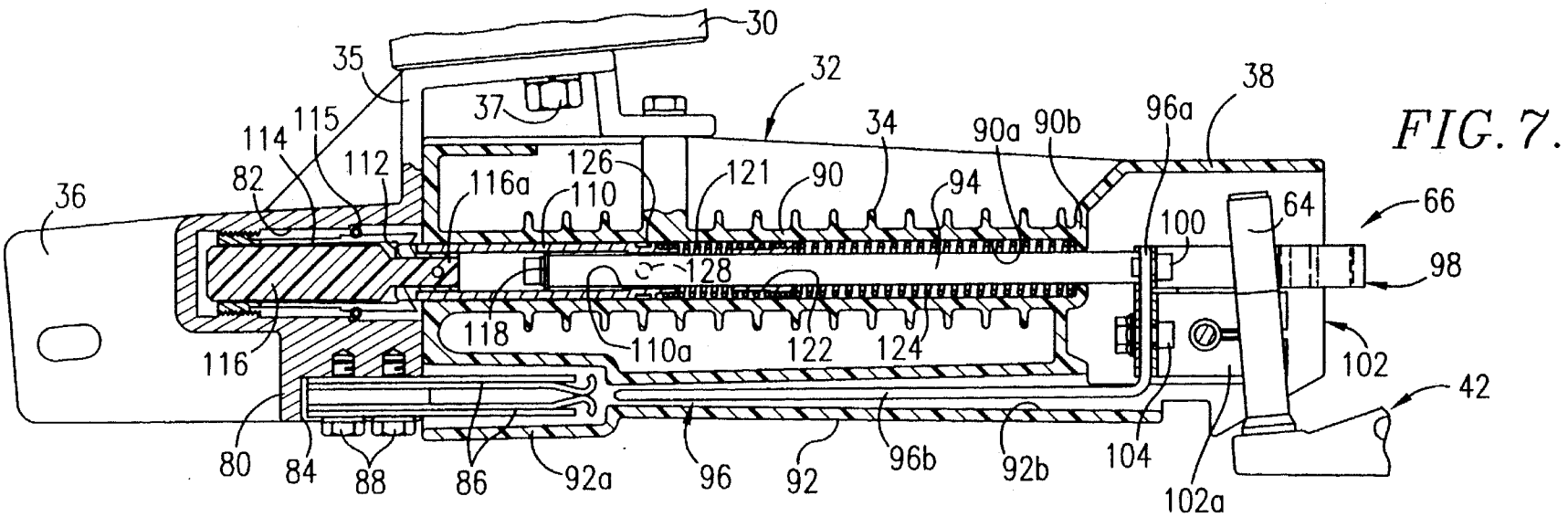
FIG. 7 is a vertical cross sectional view similar to FIG. 3 and showing the components in their beginning open positions where current is transferred to the interrupting chamber.

Referring to FIG. 7, it can be seen that as fuse 40 is swung clockwise by the lineman, the contact extension 64 in engagement with the interference presented by stop legs 98*d* of contact 98, exerts a force in a direction away from body 44 causing terminal 66 and the blade contact 96 to move with contact extension 64. The result is disengagement of main leg 96*b* of blade 96 from contacts 86. However, current continues to flow through device 32 via a path defined by terminal 36, end fitting 80, petal contact 114, contact 112, sleeve 110, spring 121, cylindrical element 122, conductive rod member 94, contact blades 98 and 102, fuse 40, bracket 52, terminal 60 and conductor 62.

Continued rotation of fuse 40 in a clockwise direction as force is exerted thereon interrupts the current path through section 90 of device 32. Movement of the contact extension 64 of fuse 40 to the right viewing FIG. 8, causes the moveable terminal 66 to be shifted by the contact extension 64 thus exerting a pull on conductive rod member 94. Upon engagement of the flange means 118 of rod member 94 with shoulder 110*a* of sleeve 110, contact 112 carried by sleeve 110 starts to slide along but remains in engagement with the petal leaves of contact 114.

Figure 8:
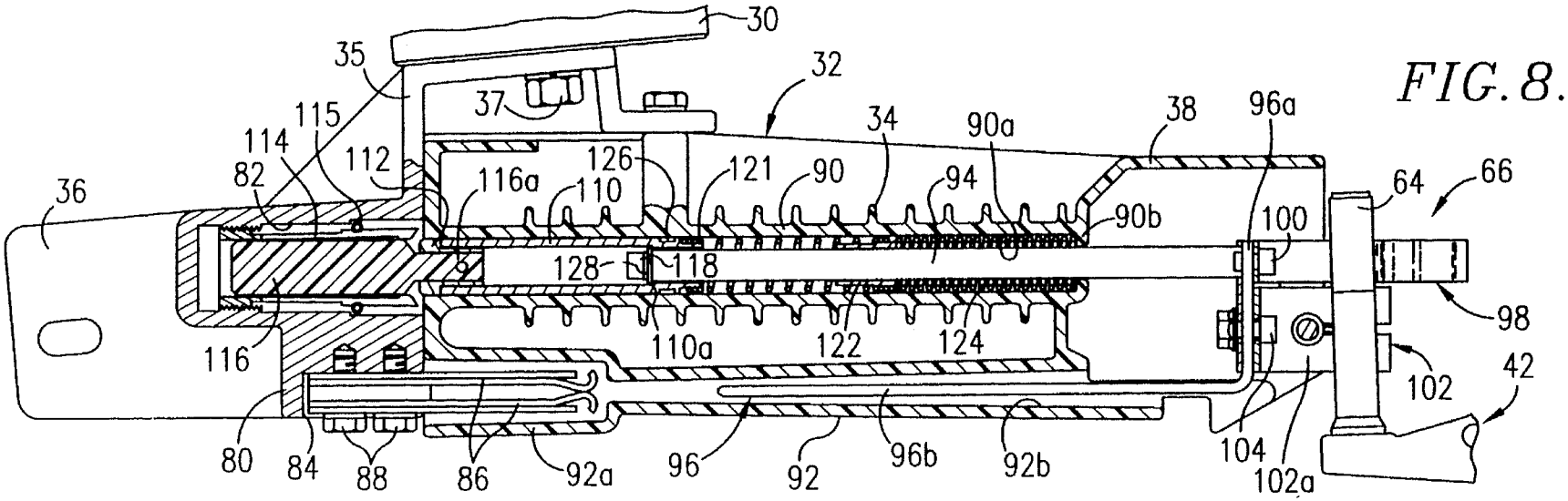
FIG. 8 is a vertical cross sectional view similar to FIG. 7 and showing the interrupter in the initial tripped condition where an arc is drawn between the adjacent current carrying components.

During initial sliding movement of sleeve 110, detent 128 is biased out of groove 126 to cause the detent 128 to ride up on the outer major surface sleeve 110. Movement of detent 128 out of groove 126 results in a snap action disengagement of contact 112 from the petal leaves of contact 114. Snap action movement of contact 112 and associated sleeve 110 is produced by spring 121 which undergoes expansion as illustrated in FIGS. 7 and 8, and thus exerts a force on sleeve 110 and associated contact 112 to acceleratedly displace the contact 112 from its engagement with petal contact 114. Such accelerated movement continues until the cylinder 116 has moved to the position thereof illustrated in FIG. 9. The arc generated between contact 112 and the leaves of petal contact 114 upon separation of the contacts is quickly extinguished by the hot gases resulting from heat reactive ablation of the synthetic resin material making up body 34 and cylindrical member 116.

Figure 9:
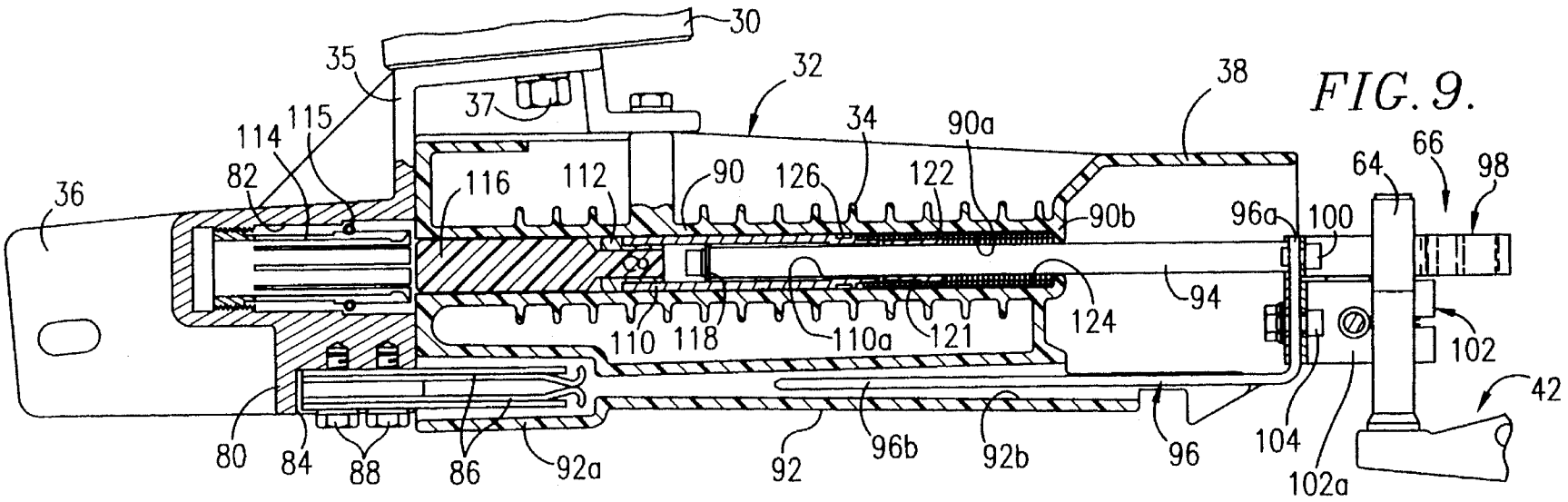
FIG. 9 is a vertical cross sectional view illustrating the positions of the interrupter components for extinguishing the arc after tripping of the interrupter as depicted in FIG. 8.
Figure 10:
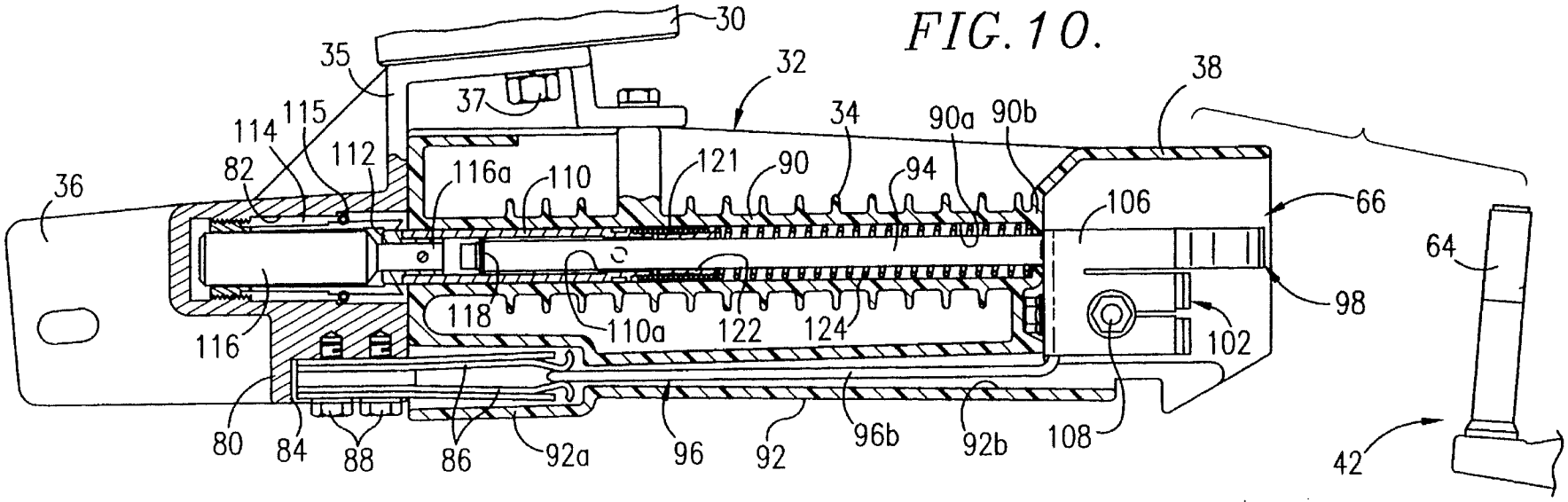
FIG. 10 is a vertical cross sectional view similar to the preceding views illustrating the interrupter in its reset condition, but with the circuit open as a result of swinging of the fuse contact extension away from the moveable terminal of the interrupter.

Rotation of fuse 40 and the contact extension 64 thereon viewing FIG. 9 also compresses spring 124 between cylindrical element 122 and end wall 90*b* of section 90. When the coil spring 124 is fully compressed as shown in FIG. 9, the conductive rod member 94 may no longer move a direction outwardly of tubular section 90. As a consequence, the contact extension 64 of fuse 40 separates the leg portions 98*c* of contact element 98, and also disengages from contact member 102 to totally interrupt the circuit extending between terminal 36 and conductor 62, as shown by FIG. 10.

As soon as the contact extension 64 has cleared terminal 66 of interrupting device 32, coil spring 124, which has been compressed as shown in FIG. 9, is free to return conductive rod member 94 and sleeve 110 to the initial positions thereof, with the contact 112 in engagement with petal contact 114. The electrical circuit is open, but the interrupting device 32 has been reset.

When the lineman elects to reclose the circuit by swinging fuse 40 into its initial circuit completing position as shown in FIGS. 1 and 3, the contact extension 64 first engages the arcing horn leg portions 98*c* of the contact 98 forming a part of terminal 66. Thus, any arc that occurs is with the arcing horns presented by leg portions 98*c* of contact 98. Continued swinging movement of the fuse 40 and inward movement of contact extension 64 causes the leg portions 98*c* of contact 98 to separate and accommodate contact extension 64 in the position thereof shown in FIG. 5. The contact extension 64 also reengages the contact legs 102*a* of main contact 102.

Figure 2:
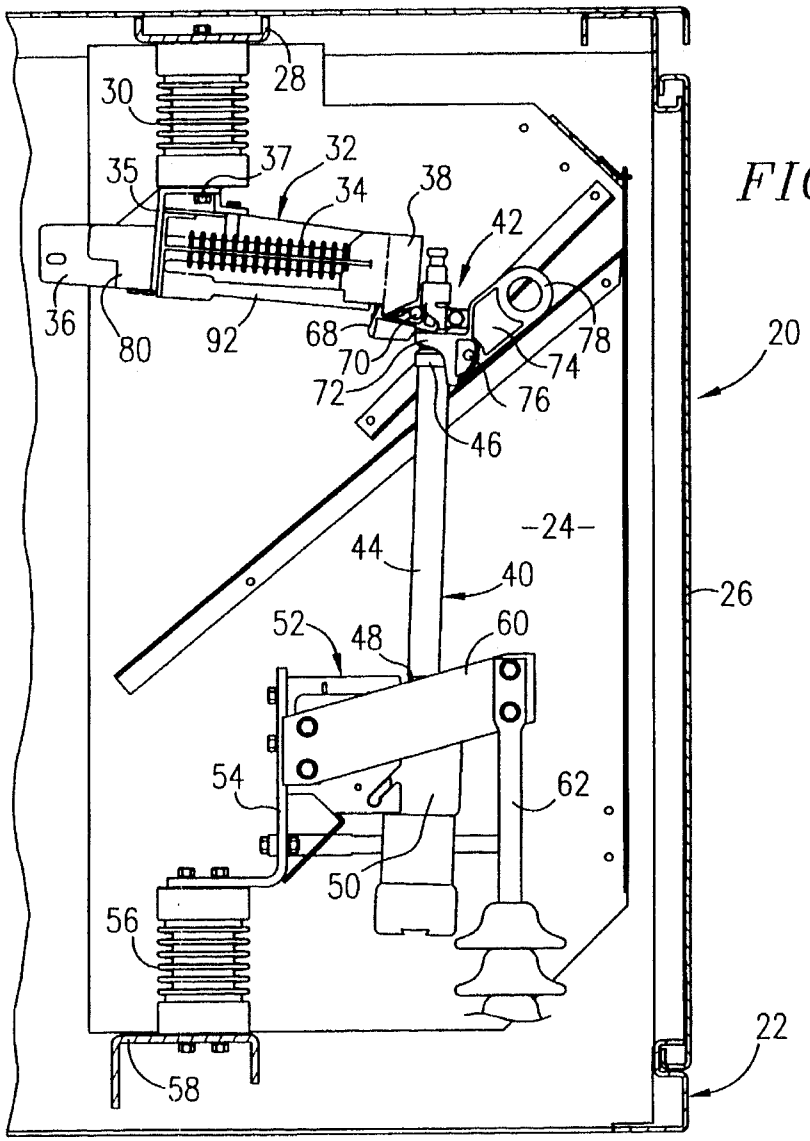
FIG. 2 is a fragmentary vertical cross sectional view similar to FIG. 1 and illustrating another type of conventional power fuse usable with the load interrupting device hereof.

The switchgear unit 120 illustrated in FIG. 2 is the same as unit 20 except for the provision of a power fuse 140 of a different specific type than fuse 40. An exemplary power fuse 140 in this respect may be a S & C Electric Company Model SML-4Z fuse. Except for the provision of a bracket 152 which accommodates the type of fuse illustrated in FIG. 2, and the fact that the contact and latch assembly 142 and the fuse pivot mounting pin structure of fuse 140 are specifically different from fuse 40, switchgear unit 120 is the same as unit 20, including load interrupting device 32.

It can be seen from the foregoing that during use of load interrupting device 32 in fused padmounted switchgear of the type shown in FIGS. 1 and 2, that interruption of a high voltage energized circuit may be accomplished safely and efficiently, and in a manner that is totally independent of speed of which a lineman may pull on fuse 40 or the fuse 140 to disengage such fuse from terminal 66 of the interrupter. Displacement time of the contact 112 from engagement with the petal contact 114 is unrelated to the swinging velocity of the fuse 40 or 140 as the latter is operated by a lineman.

As soon as the detent 128 is cammed out of the groove 126 in sleeve 110, contact 112 is acceleratedly disengage from contact 114, and the arc created is quickly extinguished by the hot gases produced from cylindrical member 116 as it is acceleratedly pulled out of the bore 82 of end fitting 80.

The provision of parallel electrical paths through device 32 permits the utilization of low resistance contact and current conveyed components during normal use of device 32, and allows that main current path to be broken without erosion of metal, while the secondary path is through an interruption chamber specifically designed to interrupt the current in a manner that minimizes deterioration of the parts of the interrupter, and at the same time assures a positive and rapid current interruption and arc extinguishment.

I claim:

1. A device for interrupting a high voltage electrical circuit comprising:

an elongated tubular body of insulating material;

first and second electrical terminals mounted on the body in spaced relationship and each adapted to be connected to the electrical circuit, the second electrical terminal being moveable with respect to the first terminal;

first means for establishing a first current path on the body between the first terminal and the second terminal when the second terminal is in one position thereof, and for electrically interrupting said first current path when the second terminal has been moved a predetermined distance away from the first terminal;

second means for establishing a second current path on the body in parallel electrical relationship with said first electrical path when the first current path establishing means is in said one position thereof, and for maintaining said second current path after said first current path has been interrupted during movement of the second terminal away from said second terminal; and means forming a part of said second means for rapidly interrupting said second current path and extinguishing the arc created by interruption of the electrical current passing along said second path, in response to movement of the second terminal in a direction away from the first terminal beyond said predetermined distance.

2. A device for interrupting a high voltage electrical circuit as set forth in claim 1, wherein said means for rapidly interrupting said second current path includes snap action mechanism having components in normal electrical interengagement and operable to cause one component to acceleratedly move away from another component to interrupt the circuit therebetween.

3. A device for interrupting a high voltage electrical circuit as set forth in claim 2, wherein is provided arc extinguishing means in operable association with said mechanism for extinguishing the arc generated between said one component and the other component upon electrical separation thereof.

4. A device for interrupting a high voltage electrical circuit as set forth in claim 1, wherein is provided means for preventing immediate reestablishment of the electrical circuit upon reclosing of said first electrical path.

5. A device for interrupting a high voltage electrical circuit as set forth in claim 1, wherein said first terminal includes a first contact within the body, and said first means includes an elongated conductive element within the body, connected to the second terminal, moveable therewith, engaging said first contact when the second terminal is in said one position thereof, and moveable out of engagement with the first contact when the second terminal has been moved said predetermined distance away from the first terminal.

6. A device for interrupting a high voltage electrical circuit as set forth in claim 5, wherein is provided an elongated, electrically conductive first member within the body, generally parallel to and spaced from said conductive member, and electrically connected to said second terminal, a second contact within the body electrically connected to said first terminal, said first member normally being in electrical engagement with said second contact when the second terminal is in said one position thereof, and means for acceleratedly moving said first member out of electrical engagement with said second contact in response to movement of the second terminal in a direction away from the first terminal beyond said predetermined distance of movement thereof.

7. A device for interrupting a high voltage electrical circuit as set forth in claim 6, wherein said means for acceleratedly moving said member out of electrical engagement with said second contact includes an elongated, electrically conductive second member within the body in generally coaxial relationship to the first member and joined to said second terminal for movement therewith, spring means for interconnecting the first and second members, and means for retarding movement of the first member with the second member as a result of the spring interconnection therebetween until after the second terminal and the second member also connected thereto have both moved through a displacement sufficient for the conductive element to disengage from the first contact.

8. A device for interrupting a high voltage electrical circuit as set forth in claim 7, wherein said means for retarding movement of the first member includes a spring biased detent releasably engageable with the first member.

9. A device for interrupting a high voltage electrical circuit as set forth in claim 8, wherein is provided spring means surrounding the second member and operable to move the first member to its position in engagement with the first contact when the second terminal is returned to the initial position thereof with the conductive element engaging the first terminal.

10. A device for interrupting a high voltage electrical circuit as set forth in claim 1, wherein is provided a fuse unit for interrupting the circuit when a fault occurs, means for mounting a fuse unit in a position for movement relative to said tubular body, said fuse unit in the normal operable position thereof including an extension releasably engageable with the second terminal for moving the terminal in response to manual movement of the fuse unit.

11. A device for interrupting a high voltage electrical circuit as set forth in claim 10, wherein said extension of the fuse unit disengages from the second terminal after the fuse unit has moved through a path of travel sufficient to cause the first member to move out of engagement with the first contact.

12. A device for interrupting a high voltage electrical circuit as set forth in claim 11, wherein said second terminal includes contacts normally embracing the extension of the fuse unit, and moveable relatively to clear the extension during continued movement of the fuse unit after said first member has moved out of engagement with the first contact.

* * * * *